US005749557A

United States Patent [19]

Chang

[11] Patent Number: 5,749,557

[45] Date of Patent: May 12, 1998

[54] HEIGHT ADJUSTING DEVICE FOR A CHAIR

[75] Inventor: Shu-chuan Chang, Tainan Hsien, Taiwan

[73] Assignee: Huang Ching-Feng, Taipei, Taiwan

[21] Appl. No.: 652,135

[22] Filed: May 23, 1996

[51] Int. Cl.[6] ..... F16M 11/00

[52] U.S. Cl. ..... 248/405; 248/409; 248/415; 297/344.18

[58] Field of Search ..... 248/415, 425, 248/405, 578, 575; 297/344.18, 344.22, 344.19

[56] References Cited

U.S. PATENT DOCUMENTS

| | | | |
|---|---|---|---|
| 3,923,280 | 12/1975 | Good | 248/405 |
| 4,493,469 | 1/1985 | Holobaugh | 297/344.18 |
| 4,720,071 | 1/1988 | Nelson et al. | 248/406.2 |
| 4,753,409 | 6/1988 | Wilcox | 248/578 |
| 4,860,987 | 8/1989 | Warner | 248/405 |
| 4,872,635 | 10/1989 | Knoblock et al. | 297/344.18 |
| 5,031,869 | 7/1991 | Strater et al. | 297/344.18 |

FOREIGN PATENT DOCUMENTS

| | | | |
|---|---|---|---|
| 2343328 | 8/1972 | Germany | 248/405 |
| 2065462 | 7/1981 | United Kingdom | 248/405 |

*Primary Examiner*—Ramon O. Ramirez
*Assistant Examiner*—Kimberly T. Wood
*Attorney, Agent, or Firm*—Head, Johnson & Kachigian

[57] ABSTRACT

A height adjusting device for a chair consists of an inner tube having a top end fixedly connected to a chair seat and a bottom end fixedly connecting with a bushing, a positioning tube extending upwardly from a chair base, having an upper end mounted with a sleeve for receiving the inner tube and a base plate defining a plurality of downward protrusions, a screw having a threaded upper section for threadedly engaging with the bushing and a reduced lower section defining an annular stepped edge and a bottom end extending through the base plate to fixedly attach with an engaging member defining a plurality of upward protrusions for releasably engaging with the downward protrusions of the base plate, the threaded upper section of the screw defining a top projection and a bottom projection for limiting the traveling of the bushing therealong, a spring and a bearing assembly being mounted around the reduced lower section of the screw and located between the base plate and the threaded upper section of the screw.

12 Claims, 9 Drawing Sheets

HEIGHT ADJUSTING DEVICE FOR A CHAIR

FIELD OF THE INVENTION

The present invention is related to a height adjusting device for a chair, particularly to a screw-type height adjusting device for a chair.

BACKGROUND OF THE INVENTION

The Applicant has filed a U.S. patent application on Jul. 10, 1995, which is entitled "Height Adjusting Device for Chairs" and assigned Ser. No. 08/500,200 now abandoned. This application and its cited prior art references during prosecution thereof are related to the background of art of the present invention.

FIG. 7 is a cross-sectional view of the height adjusting device in accordance with the '200 application. FIG. 8 is an enlarged cross-sectional view of a lower part of the height adjusting device of the '200 application when the device is in an inoperative mode. The height adjusting device of the '200 application has the following problems.

Firstly referring to FIG. 7, there is no blocking means which can limit the traveling distance of the inner tube 21' along the screw 23'; thus, when adjusting the height of the chair seat 10' by rotating the seat 10' about the base 11', the inner tube 21' may move too high or too low to engage with the screw 23'. If this situations happens, it requires the user to re-engage the inner tube 21' and the screw 231, which is laborious.

Furthermore, also referring to FIG. 8, when the user sits on the chair seat 10', the weight of the user, which causes a disengagement between the protrusions 262' and the recesses 225', is totally supported by the spring 24'. Such a design may cause the spring 24' to suffer accelerated fatigue after a term of use of the chair. If this situation happens, the protrusions 262' can no longer securely engage in the recesses 225' even if there is no load on the chair seat 10', which, in turn, will cause that the height adjusting device 20' cannot normally function when it is in an operative mode.

The present invention therefore is aimed to provide an improved height adjusting device for a chair to mitigate and/or obviate the aforementioned problems concerning the U.S. patent application No. 08/500,200.

SUMMARY OF THE INVENTION

One object of the present invention is to provide a height adjusting device for a chair wherein the height of the chair can be adjusted by rotating the chair seat when there is no load on the seat of the chair.

Another object of the present invention is to provide a height adjusting device for a chair wherein when there is a load on the chair, rotation of chair seat will not cause a change of the height of the chair seat.

A future objective of the present invention is to provide a height adjusting device for a chair wherein the device is provided with blocking means which can limit the top and bottom positions so that the chair seat can be adjusted.

Still a future objective of the present invention is to provided a height adjusting device for a chair wherein when there is a load on the chair seat, the load will not be solely supported by a spring of the height adjusting device.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
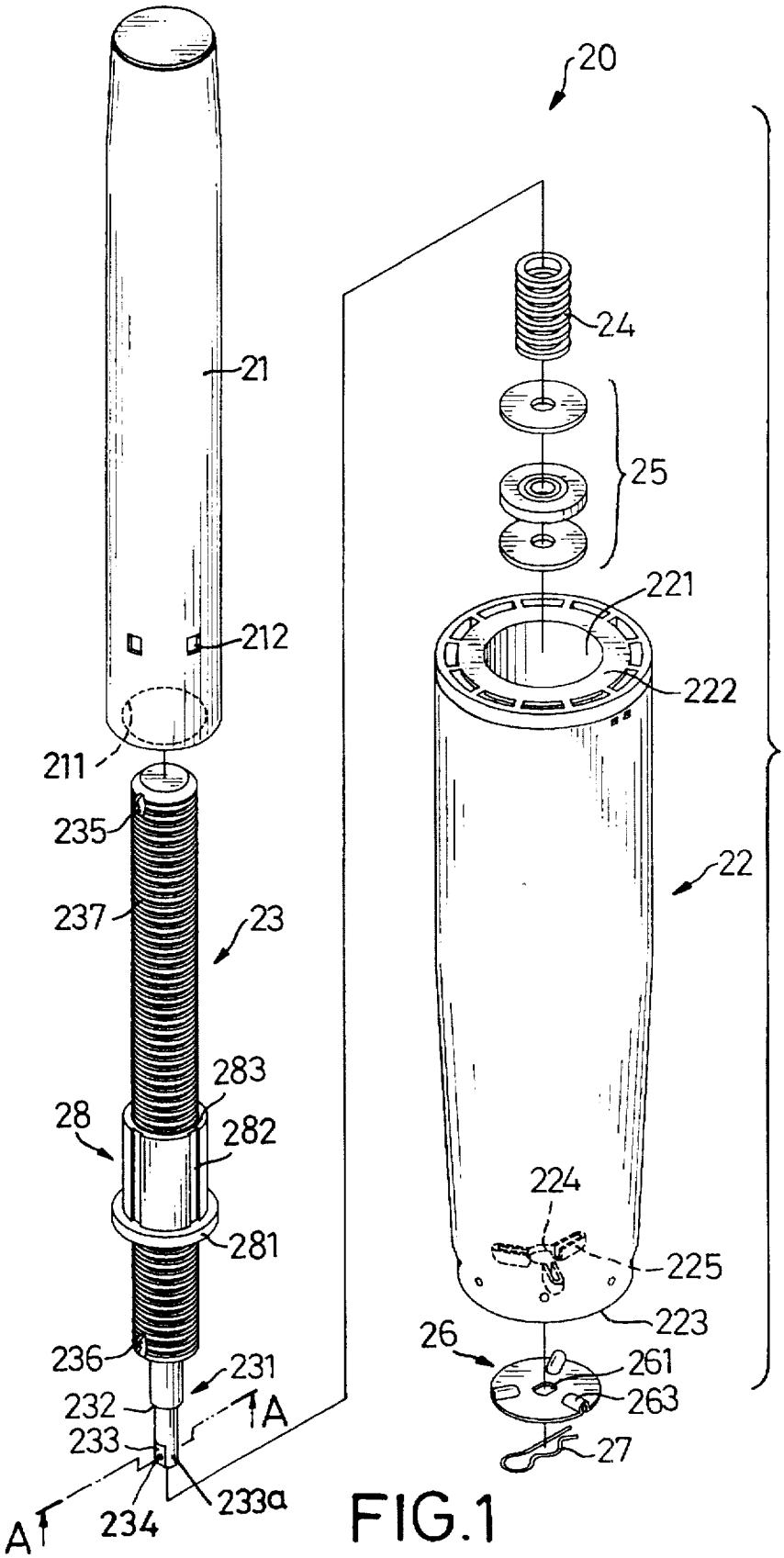
FIG. 1 is an exploded view of a height adjusting device for a chair in accordance with the present invention.
Figure 1A:
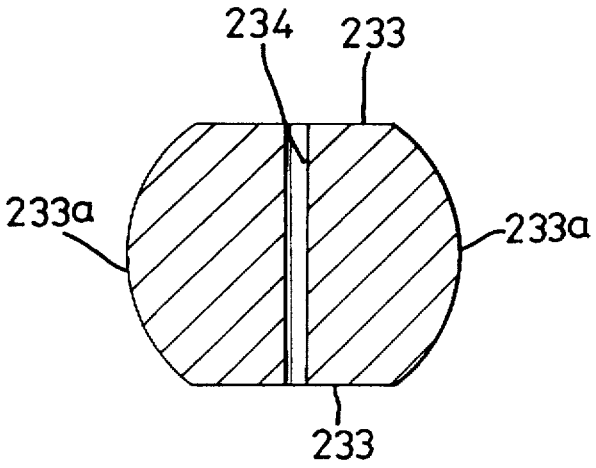
FIG. 1A is a cross-sectional view taken from the line A—A of FIG. 1.
Figure 2:
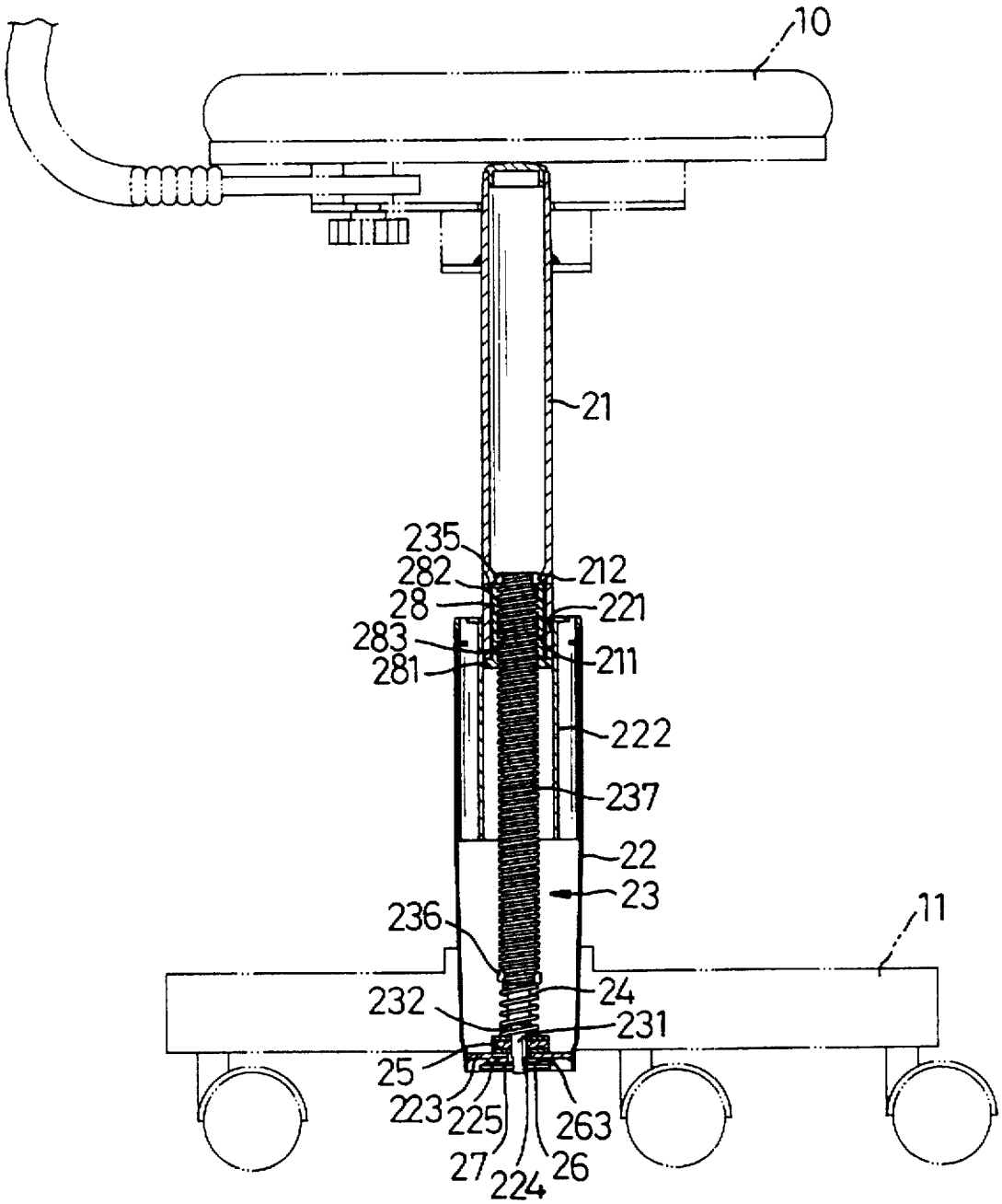
FIG. 2 is a cross-sectional view of the height adjusting device in which a chair seat is adjusted to its top position.

Firstly referring to FIGS. 1 and 2 of the drawings, a height adjusting device 20 for a chair in accordance with the present invention is mounted between a chair seat 10 and a chair base 11 which is preferably equipped with casters (not labeled). The height adjusting device 20 includes an inner tube 21 having a top end fixedly attached to an underside of the chair seat 10 by a known means, for example, welding, and a lower end with a smooth opening 211, a screw 23 having a threaded upper section 237 and a reduced lower section 231 defining an annular stepped edge 232 and a bottom end configured to have a pair of opposed, parallel flat surfaces 233 and a pair of opposed arcuate surfaces (as shown in FIG. 1A) a bushing 28 made of plastic having an outer diameter slightly larger than an inner diameter of the opening 211 for having a forced fitting with the inner tube 21 and defining internal threads 283 which allow the bushing 28 to be screwed onto and along the threaded upper section 237 of the screw 23, a positioning tube 22 extending upwardly from the base 11, a sleeve 222 fixedly secured in an upper end of the positioning tube 22 and having a through hole 221 having an inner diameter slightly greater than an outer diameter of the inner tube 21 for fittingly and partially receiving the inner tube 21, and a base plate 223 (see FIG. 2) which is securely mounted to a lower end of the positioning tube 22 and which has a central hole 224 and a plurality of downward protrusions 225 arranged around the central hole 224.

The height adjusting device 20 further includes a spring 24, a bearing assembly 25, an engaging member 26 and a lock pin 27. The engaging member 26 defines a central hole 261 having a configuration corresponding to that of the bottom end of the reduced lower section 231 of the screw 23, and a plurality of upward protrusions 263 arranged around the central hole 261.

The inner tube 21 is also formed with a plurality of indentations 212 (only two being seen in FIG. 1) on a periphery thereof. The bushing 28 is also formed with a bottom flange 281 and a plurality of grooves 282 extending axially on a periphery of the bushing 28. The screw 23 also defines a pin hole 234 extending through the bottom end of the reduced lower section 231 of the screw 23.

When assembling the height adjusting device 20, firstly at a bottom end of the threaded upper section 237 of the screw 23, two bottom projections 236 are formed thereon by a punching operation on the threaded upper section 237. These bottom projections 236 define a bottom limit in which the chair seat 10 can be lowered. Then the bushing 28 is screwed onto threaded upper section 237 of the screw 23 to a position, for example, as shown by FIG. 1. Thereafter, two upper top projections 235 are formed on a top end of the threaded upper section 237 of the screw 23 by a manner like that forming the bottom projections 236. The top projections 235 define a top limit in which the chair seat 10 can be lifted.

Then, the spring 24 and the bearing assembly 25 is assembled with the screw 23 by extending the reduced lower section 231 of the screw 23 through the spring 24 and the bearing assembly 25, in which the spring 24 is located between the threaded upper section 237 and the bearing assembly 25. Thereafter, the bottom end of the screw 23 is brought to extend through the central hole 224 of the base plate 223, to matingly fit with the central hole 261 of the engaging member 26, and then be secured in position by the lock pin 27 being extending through the pin hole 234 defined in the bottom end of the screw 23, wherein as mentioned above, the central hole 261 of the engaging member 26 has a configuration corresponding to that of the bottom end of the reduced section 231 of the screw 23.

Finally, the inner tube 21 is fixedly connected with the bushing 28 by forcedly fitting the inner tube 21 defining the opening 211 onto the bushing 28 until the inner tube 21 reaches the position as shown by FIG. 2, in which a bottom edge of the inner tube 21 is rested on the bottom flange 281 of the bushing 28 and a bottom end of the indentations 212 is rested on a top edge of the bushing 28. The axial grooves 282 are used to facilitate the forced fitting between the bushing 28 and the inner tube 21. By the forced fitting between the bushing 28 and the inner tube 21, when the inner tube 21 is rotated by rotating the chair seat 10, the bushing 28 will rotate accordingly.

Figure 3:
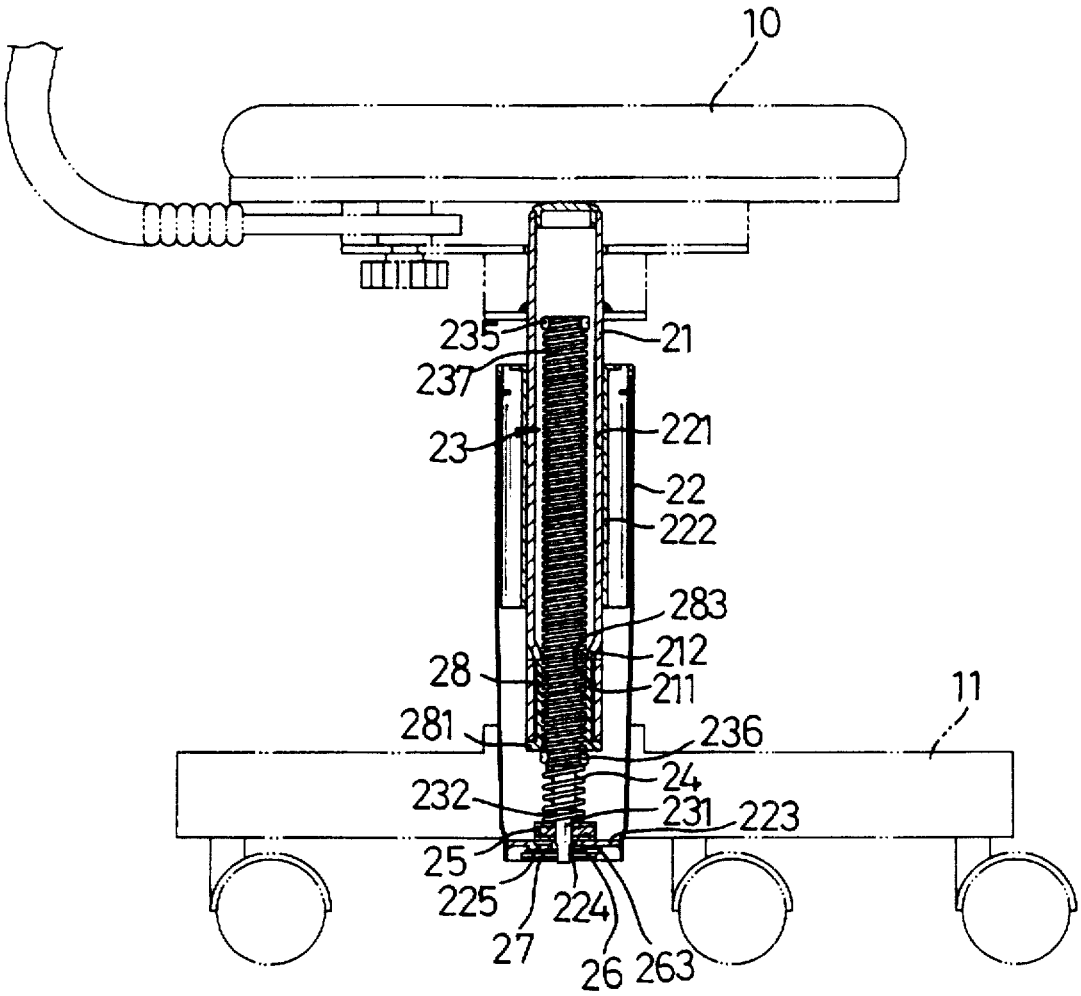
FIG. 3 is a cross-sectional view of the height adjusting device in which the chair seat is adjusted to its bottom portion.
Figure 4:
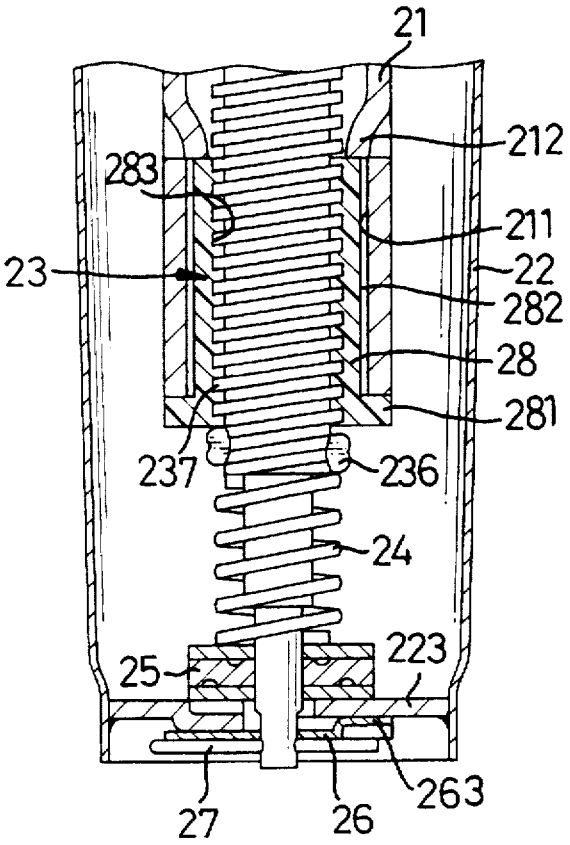
FIG. 4 is an enlarged cross-sectional view of a lower part of the height adjusting device in FIG. 3, illustrating an operative mode thereof.

In use, referring to FIGS. 2, 3 and 4, the user may simply rotate the chair seat 10 to achieve a height adjustment of the chair seat 10 when not loaded. This is because the upward protrusions 263 of the engaging member 26, under action of the spring 24, are forced to rest against a bottom face of the base plate 223. When the user rotates the chair seat 10 when not loaded, the engaging member 26 may be initially rotated with the screw 23, the bushing 28 and the inner tube 21; however, thereafter the upper protrusions 263 of the engaging member 26 will certainly engage with and be blocked by the downward protrusions 225 of the base plate 223; thus, the rotation of the engaging member 26 and the screw 23 which is fixedly connected with the engaging member 26 is prevented. Thus, the screw 23 is securely positioned. At this position, rotation of the chair seat 10 causes upward or downward movement of the bushing 28 together with the inner tube 21 and the chair seat 10.

The chair seat 10 can be moved upwardly until the top edge of the bushing 28 is blocked by the top projections 235 formed on the threaded upper section 237 of the screw 23, as shown by FIG. 2. Alternatively, the chair seat 10 can be moved downwardly until the bottom flange 281 of the bushing 28 is blocked by the bottom projections 236 formed on the threaded upper section 237 of the screw 23, as shown by FIGS. 3 and 4. Since the traveling of the bushing 28 along the threaded upper section 237 of the screw 23 is limited by the upper and lower projections 235, 236, the bushing 28 cannot escape from its engagement with the threaded upper section 237 of the screw 23 by an inadvertent rotation of the chair seat 10. Thus, the engagement between the bushing 28 and the threaded upper section 237 of the screw 23, and, thus, the engagement between the inner tube 21 together with the chair seat 10 and the screw 23 can always be ensured.

Furthermore, if the bushing 28 is rotated to move along the screw 23 to reach its top or bottom position and the rotation thereof is still continued, the bushing 28 will force the screw 23 and the engaging member 26 to rotate therewith, in which the upward protrusions 263 on the engaging member 26 will be forced to repeatedly escape from and re-engage with the downward protrusions 225 defined on the base plate 223 to generate a clicking sound thereby to notify the user that the height of the chair seat 10 has been adjusted to its top or bottom position.

Figure 5:
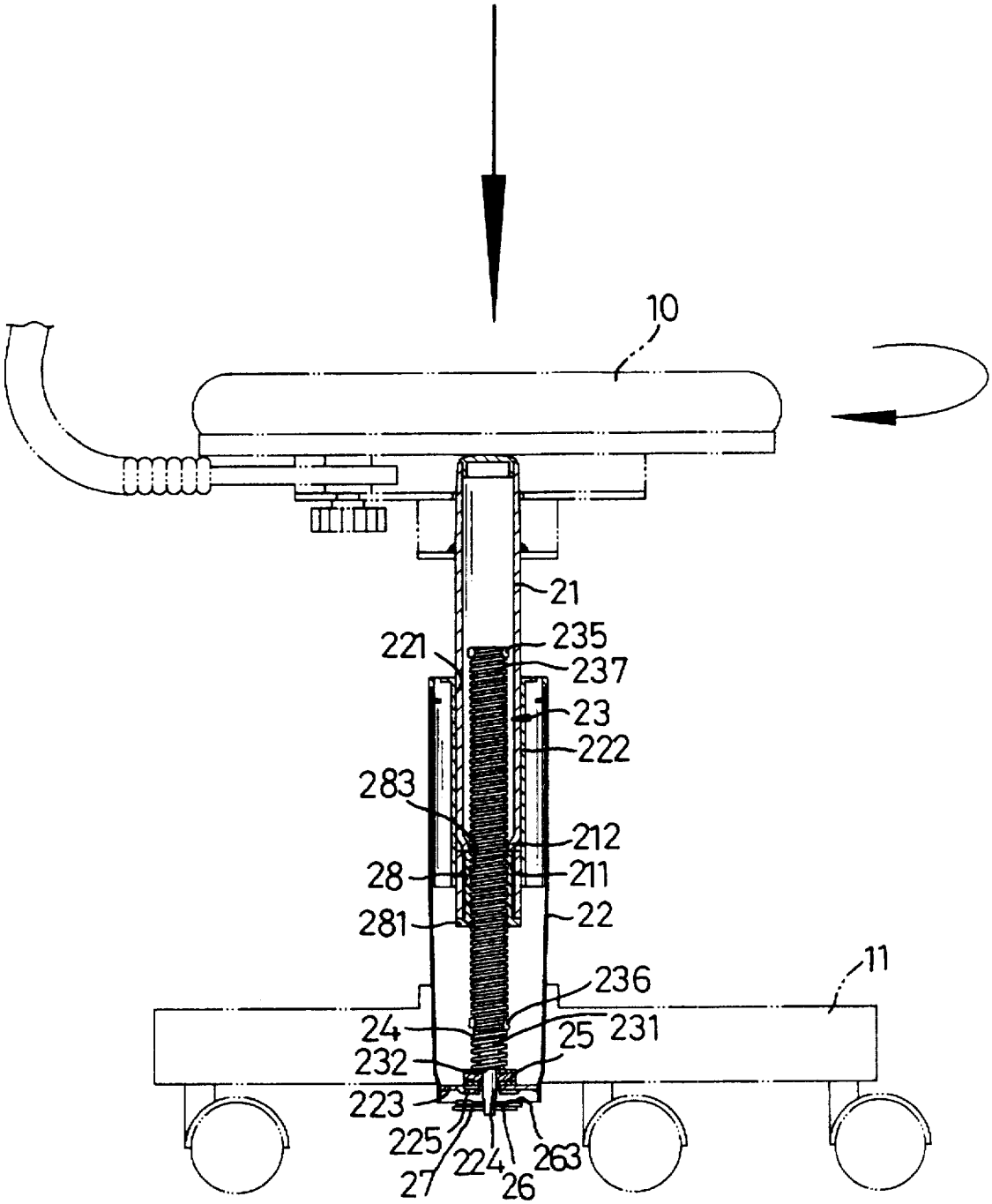
FIG. 5 is a cross-sectional view illustrating the height adjusting device in a loaded status.
Figure 6:
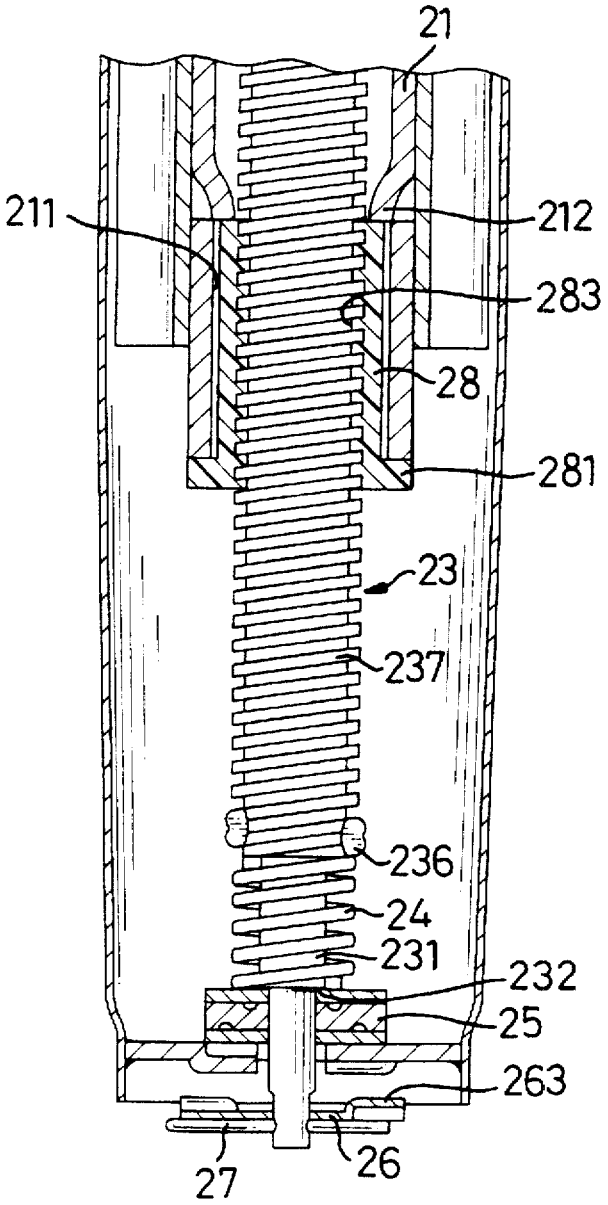
FIG. 6 is an enlarged cross-sectional view of a lower part of the height adjusting device in FIG. 5, illustrate an inoperative mode thereof.
Figure 7:
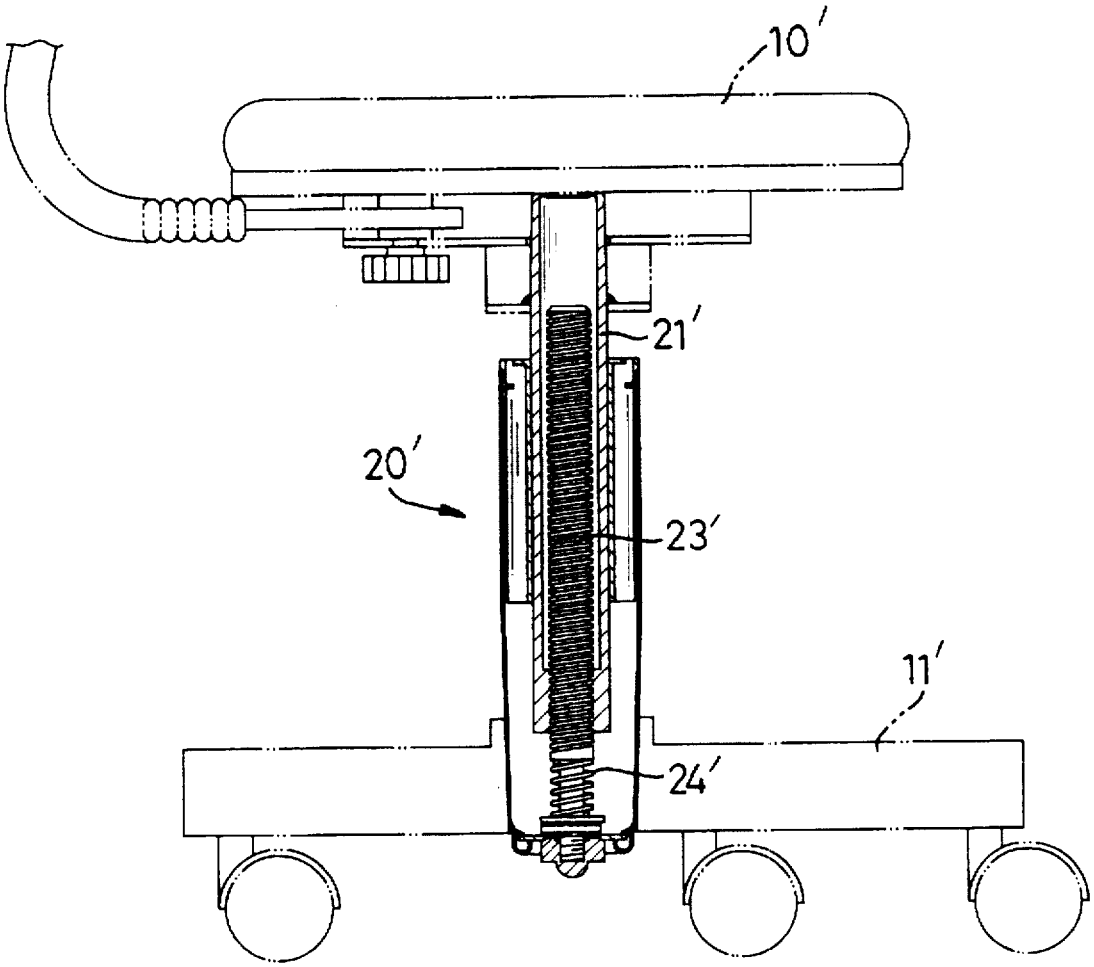
FIG. 7 is a cross-sectional view of a height adjusting device for chairs in accordance with U.S. patent application No. 08/500,200.
Figure 8:
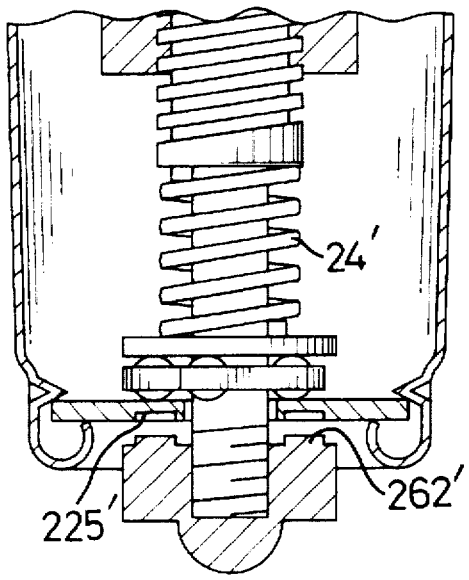
FIG. 8 an enlarged cross-sectional view of a lower part of the height adjusting device of the U.S. patent application No. 08/500,200, wherein the device is in an inoperative mode.

Turning now to FIGS. 5, when the chair seat 10 is loaded, e.g., the user sits on it, the inner tube 21 together with the bushing 28 and the screw 23 move downwardly and thus the spring 24 is compressed such that the upward protrusions 263 of the engaging member 26 leave the base plate 223 a sufficient distance and will not engage with and be blocked by the downward protrusions 225 of the base plate 223 when the engaging member 26 is rotated with the screw 23, as detailedly illustrated in FIG. 6. Accordingly, the lower end of the screw 23 is not secured in position, and rotation of the chair seat 10 causes free rotation of the inner tube 21 together with the bushing 28 and the screw 23, i.e., the height of the chair seat 10 remains the same.

Particularly referring to FIG. 6, as mentioned above, the reduced lower section 231 of the screw 23 is equipped with an annular stepped edge 232 which, when the spring 24 is compressed due to the chair seat 10 being loaded to cause the upward protrusions 263 to leave the base plate 26 a sufficient distance so that the upper protrusions 263 will not engage with and be blocked by the downward protrusions 225, will rest on the bearing assembly 25 thereby to support a part of the load. Thus, in the present invention, the load acting on the chair seat 10 will not be solely supported by the spring 24, whereby the spring 24 will not suffer abnormal fatigue even if the present height adjusting device 20 for a chair has been used for a long term, and, therefore, the present height adjusting device 20 for a chair can always normally function when it is in an operative mode.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A height adjusting device comprising:

an inner tube having an upper end and a lower end;

a bushing fixedly connected with the lower end of the inner tube and defining internal threads;

a positioning tube having an upper end and a lower end, a sleeve securely mounted in said upper end of said positioning tube and having an inner diameter slightly greater than an outer diameter of said inner tube for fitting and partially receiving the inner tube and allowing axial and rotational movement of said inner tube, and a base plate securely mounted to the lower end of the positioning tube and having a central hole and a plurality of downward protrusions arranged around the central hole;

a screw defining a threaded upper section for the bushing to be screwed thereto and to be moved therealong and a reduced lower section, said threaded upper section comprising a top and bottom blocking means for limiting the traveling of the bushing therealong between a top position and a bottom position, said reduced lower section defining a bottom and extending through the central hole of the base plate;

a bearing assembly and a spring mounted around the reduced lower section of the screw and located between the base plate and the threaded upper section of the screw; and an engaging member fixedly attached to the bottom end of the reduced lower section of the screw and defining a plurality of upward protrusions for releasably engaging with the downward protrusion defined in the base plate.

2. The height adjusting device in accordance with claim 1, wherein the top and bottom blocking means are respectively in a form of at least one projection formed on the threaded upper section of the screw.

3. The height adjusting device in accordance with claim 1, wherein the reduced lower section further comprises a stepped edge positioned between the bearing assembly and the threaded upper section of the screw.

4. The height adjusting device in accordance with claim 1, wherein the bottom end of the reduced lower section is configurated to have a pair of opposed, parallel flat surfaces and a pair of opposed arcuate surfaces and has a pin hole extending therethrough.

5. The height adjusting device in accordance with claim 4 further comprising a lock pin and wherein the engaging member is fixedly attached to the bottom end of the reduced lower section of the screw by fittingly extending the bottom end through a central hole defined in the engaging member which has a configuration corresponding to that of the bottom end and then extending the lock pin through the pin hole.

6. The height adjusting device in accordance with claim 1, wherein the lower end of the inner tube defines an opening having an inner diameter slightly smaller than an outer diameter of the bushing and the fixed connection between the bushing and the lower end of the inner sleeve is achieved by a forced fitting of the lower end of the inner tube onto the bushing.

7. The height adjusting device in accordance with claim 6, wherein the inner tube further comprises a plurality of indentations formed on a periphery thereof and when the bushing and the lower end of the inner tube are fixedly connected together, the indentations are rested on a top edge of the bushing.

8. The height adjusting device in accordance with claim 7, wherein when the bushing is moved upwardly to its top position, the top edge of the bushing is blocked by the top blocking means on the threaded upper section of the screw.

9. The height adjusting device in accordance with claim 1, wherein the bushing is formed with a bottom flange.

10. The height adjusting device in accordance with claim 9, wherein when the bushing is moved downwardly to its bottom position, the bottom flange of the bushing is blocked by the bottom blocking means on the threaded upper section of the screw.

11. The height adjusting device in accordance with claim 1, wherein the bushing is formed with grooves defined axially along a periphery of the bushing.

12. The height adjusting device in accordance with claim 1, wherein the bushing is made of plastic.

* * * * *

UNITED STATES PATENT AND TRADEMARK OFFICE

CERTIFICATE OF CORRECTION

PATENT NO. : 5,749,557
DATED : May 12, 1998
INVENTOR(S) : Shu-chuan Chang

It is certified that error appears in the above-indentified patent and that said Letters Patent is hereby corrected as shown below:

Col. 1, line 29, delete "231" and substitute --23'" therefor;
Col. 2, line 42, after "surfaces" and before "(as" insert --233a--; and
Col. 2, line 43, after "1A)", insert a --,--.

Signed and Sealed this

Twenty-eighth Day of July, 1998

Bruce Lehman

*Attest:*

BRUCE LEHMAN

*Attesting Officer*

*Commissioner of Patents and Trademarks*